US008100260B1

(12) United States Patent
Weckerle et al.

(10) Patent No.: US 8,100,260 B1
(45) Date of Patent: Jan. 24, 2012

(54) CLOSEABLE LIPSTICK

(75) Inventors: Thomas Weckerle, Peibenberg (DE); Klaus Dieckmann, Kuchen (DE)

(73) Assignee: Weckerle GmbH, Weilheim (DE)

( * ) Notice: Subject to any disclaimer, the term of this patent is extended or adjusted under 35 U.S.C. 154(b) by 0 days.

(21) Appl. No.: 12/841,278

(22) Filed: Jul. 22, 2010

(51) Int. Cl.
*B65D 79/00* (2006.01)

(52) U.S. Cl. ..... 206/385; 206/823

(58) Field of Classification Search ..... 206/385, 206/823, 581, 1.5; 132/318, 317; 401/107, 401/108

See application file for complete search history.

(56) References Cited

U.S. PATENT DOCUMENTS 3,612,072 A * 10/1971 Fukui ..... 132/218

* cited by examiner

*Primary Examiner* — J. Gregory Pickett
*Assistant Examiner* — King M Chu
(74) *Attorney, Agent, or Firm* — Howard & Howard Attorneys PLLC

(57) ABSTRACT

An enclosure (1) for a lipstick comprising at least two enclosure parts (2, 3), the two enclosure parts (2, 3) are rotated relatively to one another and at least one of the at least two enclosure parts (2, 3) comprises an opening (4) and a closing mechanism, comprising two lids (5, 6) by which the opening (4) in one of the at least two enclosure parts (2, 3) is closed and a tubular element (8), which rotates relatively to one of the enclosure parts (2, 3), when the enclosure parts (2, 3) are rotated in relation to one another, each of the two lids (5, 6) and the tubular element (8) comprise means, which move the two lids (5, 6) when the tubular element (8) is rotated, so the lids (5, 6) close or open the opening (4) and the means of the tubular element (8), interacting with one of the two lids (5, 6) and the means of the tubular element (8), interacting with the other of the two lids (5, 6) are arranged on two different circular paths on the tubular element (8).

12 Claims, 4 Drawing Sheets closed open

CLOSEABLE LIPSTICK

FIELD OF THE INVENTION

The invention concerns an enclosure, in particular an enclosure for a lipstick, for a one-handed operation of the lipstick, in particular for the one-handed opening and closing of the enclosure.

BACKGROUND OF THE INVENTION

Today a plurality of different enclosures for lipsticks are known. Merely every form and color combination of enclosures is known. Thereby, also a plurality of different mechanisms are known, in order to move the lipstick, which is also often called lipstick mine, out of the enclosure and back into the enclosure.

Known lipstick enclosures are often two pieces that means they comprise two enclosure parts, as for example shown in U.S. Pat. No. 4,108,558. Thereby one enclosure part comprises the lipstick itself, as well as a sleeve, which encloses the lipstick and a transport mechanism in order to move the lipstick out of the sleeve and back into the sleeve. The transport mechanism of known lipsticks is thereby mostly a rotation mechanism, wherein the sleeve is rotated against a base, such that a sensitive movement of the lipstick is possible. Thereby, the sleeve is normally hold between thumb and index finger of one hand of the user and the base is rotated by ease of the thumb and index finger of the other hand. The second enclosure part normally only serves as cap in order to protect the lipstick mine from dirt and desiccation. The known two-piece enclosures have the disadvantage that for utilizing the lipstick at first the cap has to be removed and subsequently has to be put aside, only then a use is possible. However, by the necessity of putting aside the cap when using such two-piece enclosures, they exhibit the disadvantage that the cap can easily be lost. However, without cap, the lipstick is not protected from dirt and desiccation, which makes the lipstick unusable. Further, a one-handed operation of such two-piece enclosures is not possible or only possible in a very user unfriendly way, since for the one-handed operation the sleeve has to be hold between thumb and index finger of one hand and the base has to be rotated by ease of the other fingers of the same hand in connection with the palm of the hand.

An enclosure for a one-handed operation of a lipstick is for example shown in US 2010/0054842 A2. The described enclosure comprises only one part at which a lid is arranged, whereby the lid closes an upper opening of the enclosure. Thereby, the lid is hold in position by a restoring force of a spring, thereby the lid is hold in a position to firmly close the upper opening of the enclosure. The lipstick can by means of a sliding mechanism be moved out of the enclosure and again back into the enclosure. The sliding mechanism comprises a sleeve in which the lipstick is arranged. When the lipstick is slid out of the enclosure by ease of the sliding mechanism, then the sleeve at first presses against the lid and opens the lid against the restoring force of the spring. Subsequently, by further sliding the sliding mechanism, the lipstick can at least partially be moved out of the enclosure and out of the sleeve, such that a user can use the lipstick. This arrangement can be used one handedly, however; it has the disadvantage that the movement of the lipstick is not very sensitive. In this arrangement at first the sleeve has to be moved out of the enclosure against the restoring force of the spring, therefore the user has to exert a relatively high force. For the subsequent movement of the lipstick, the user only needs a relatively low force. The transition from the relatively high expenditure of force to a low expenditure of force is only very difficult achievable for the user, such that there exists a risk that the lipstick always is extended to its full length. Further, such a sliding mechanism can only be practically used with a locking mechanism, which holds the extended lipstick in position. Otherwise, there is the risk when using the lipstick that by pressing the lipstick against the lips of the user, the lipstick is pressed back into the enclosure. Another possibility would only be that during use of the lipstick, the user itself holds the sliding mechanism in a particular position. However, this is very user unfriendly.

Therefore, there exist the need to provide an enclosure, in particular for a lipstick, which allows the user to use the lipstick with one hand, but which at the same time allows a sensitive and user friendly operation of a known enclosure with regards to the sensitive movement of the lipstick by means of rotation, without exhibiting the disadvantages of the prior art. This need is fulfilled by the enclosure according to independent claim 1.

SUMMARY OF THE INVENTION

The enclosure according to the invention, which in particular is intended to be used with a lipstick, comprises at least two enclosure parts, wherein the at least two enclosure parts can be rotated against one another and wherein at least one of the at least two enclosure parts comprises an opening. In the following the enclosure is described in context of a lipstick, however, the enclosure according to the invention can also be used with any other cosmetic product.

According to the invention, through an opening in one of the at least two enclosure parts, for example, a lipstick can be moved out and moved back into the enclosure. The opening has thereby preferably a similar cross section as the lipstick. Preferably, the two enclosure parts enclose the lipstick. The at least two enclosure parts can preferably be connected to each other in such a way that they can be rotated against one another, however, they can not be disconnected from each other.

According to the invention, the enclosure also comprises a closing mechanism which allows it to close the opening in one of the at least two enclosure parts and to open the opening. The closing mechanism comprises for this purpose two lids, by which the opening in one of the at least two enclosure parts can be closed. Thereby, the lids are preferably designed in such a way that they tightly fit with at least one of the at least two enclosure parts, such that the opening can be firmly closed, such that the lipstick in the enclosure can be protected from dirt and desiccation. The lids can also be designed in such a way that they partially overlap, such that at a connection line of the two lids a relatively tight closing can be created. The lids can thereby, for example, also comprise a sealing mechanism, which allows it that the lids in the closed position can be sealed against each other. Thereby, the sealing mechanism for example can be realized by a sealing along an overlapping of the at least two lids.

The closing mechanism of the enclosure according to the invention further comprises a tubular element, which is arranged inside the enclosure and which rotates relatively to one of the at least two enclosure parts, when the at least two enclosure parts are rotated in relation against one another. The both lids as well as the tubular element further comprise means, which when the tubular element is rotated, move the two lids in such a way that the lids open or close the opening, wherein the means of the tubular element, which interacts with one of the two lids and the means of the tubular element, which interacts with the other of the two lids are arranged on two different circular paths on the tubular element. Thereby, preferably, the circular paths exhibit different radii. The different circular paths of the means for moving the lids at the tubular element make it possible that a nearly full rotation of the tubular element is possible before the means of the lids and the means of the tubular element can again contact each other. This nearly full rotation of the tubular element makes a sensitive inwards and outwards motion of the lipstick possible.

In a further preferred embodiment the means for moving the lids can be represented by teeth at the lids and two independent teeth-segments, arranged at the tubular element, wherein the teeth of one of the two lids can grip into teeth of one of the two teeth-segments and the teeth of the other of the two lids can grip into teeth of the other of the two teeth-segments for moving the lids. Thereby, the teeth of the lids and the teeth of the teeth-segments can for example in the closing position, therefore when the opening is closed by the lids, interact with the teeth of the teeth-segments of the tubular element in such a way that the lids can not be opened by themselves. Only by rotating one of the at least two enclosure parts in relation to the other of the at least two enclosure parts also the tubular element is relatively to the rotation of the enclosure parts rotated. Thereby, the teeth of the teeth-segments of the tubular element as well as the teeth of the lids can interact in such a way that the lids can be opened. The teeth-segments of the tubular element are thereby for example arranged at the edge of the tubular element and are arranged on two circular paths with different radii. Further, the teeth-segments do preferably not cover the complete circumference of the tubular element but only a part. When the at least two enclosure parts are therefore rotated against one another, which leads to a relative movement of the tubular element, then the teeth of the lids and the teeth of the teeth-segments of the tubular element can only interact as long as they overlap. If the tubular element is moved further, then the teeth of the lids do not have a point of interaction anymore, such that they remain in their position. Due to the arrangement of the teeth-segments on circular paths with different radii, a nearly full rotation can be performed before the teeth of the lids can again interact with the teeth of the corresponding teeth-segments of the tubular element.

In a preferred embodiment the teeth-segments are arranged at the edge of the tubular element, wherein the teeth-segments are opposed to each other at the tubular element that means they have an offset of approximately 180° on the edge of the tubular element.

In a preferred embodiment of the enclosure, the at least one of the at least two enclosure parts, which defines the opening, comprises also a cavity for the two lids of the closing mechanism, such that they can be stored in the cavity, when they are in the open position. Hereby, it is ensured that the lids do not come in contact with further parts, for example the lipstick. This has the advantage that neither the inside nor the edges of the lids are contaminated, such that when the lids are subsequently closed no dirt can be transferred.

Further, the enclosure according to the invention and the closing mechanism also comprises a means for holding the lids in a particular position. This means can for example be a gudgeon or a limiter inside the cavity. A means for holding the lids in position is advantageously, since when the means for moving the lids at the lids do not interact anymore with the means for moving the lids at the tubular element, the holding of the lids in a particular position leads to the advantage that the means can again easily interact with each other after a rotation of the tubular element. For example, when the means are formed by teeth at the lids and by teeth-segments at the tubular element, then the lids should be hold in a particular height, such that the teeth of the lids can again interact with the teeth of the teeth-segments of the tubular element after the tubular element has completed a full rotation, respectively was rotated backwards. Thereby, the means for holding can be realized with different means and can for example also be given by the size of the cavity.

In a further preferred embodiment of the enclosure, the enclosure also comprises a limiter for limiting the rotation of the at least two enclosure parts against one another. The limiter can thereby be realized by various means. The limiter ensures that the enclosure parts can not be rotated in any arbitrary way, such that the means for moving the lids at the lids and at the tubular element can only interact one time per defined rotations. For example, are the means formed by teeth at the lids and teeth at the tubular element and if the tubular element is directly connected with one of the enclosure parts, then the limiter limits the rotation of the enclosure parts to one single rotation.

Further, the enclosure comprises a transport mechanism for transporting the lipstick out and into one of the at least two enclosure parts through the opening in one of the at least two enclosure parts. Thereby, the lipstick can not only consist of the lipstick mine itself, but also can comprise a second mine or a lotion dispenser arranged in or adjacent to the lipstick mine. By means of the transport mechanism, also the second mine or the lotion dispenser can be trans-ported out or into one of the at least two enclosure parts though the opening in one of the at least two enclosure parts. Thereby, the transport mechanism preferably comprises a cage, which at least partially holds the lipstick. The cage is thereby moved by rotating the at least two enclosure parts against one another. The transport mechanism can be a known transport unit for lipsticks. For example, the transport mechanism can comprise a cage with pins, which extend through helical recesses of the tubular element. The pins can thereby, for example, grip into vertical recesses in one of the at least two enclosure parts. However, the cage can also comprise only one pin, which can extend through a helical recess of the tubular element and can grip into one vertical recess in one of the at least two enclosure parts. In both cases, the tubular element, for example, can be operatively connected with the other of the at least two enclosure parts. When the enclosure parts are rotated against one another, then the tubular element rotates relatively to one of the at least two enclosure parts with the vertical recesses respectively with the one vertical recess. Thereby, the cage is moved upwards respectively downwards along the helical recess respectively the helical recesses of the tubular element and along the vertical recess respectively the vertical recesses of the enclosure part. Thereby, the end of the helical recess respectively the helical recesses can also be at the same time the limiter for the rotation, since the parts can not further be rotated when the end of the recess respectively the ends of the recesses is reached. The transport mechanism can therefore be represented by an interaction of the cage and the tubular element. For example, also one of the at least two enclosure parts can comprise helical recesses and the pins of the cage can extend through vertical recesses in the tubular element and grip into the helical recesses of the enclosure part. Also here for example the cage can comprise only one pin, which extends through a vertical recess in the tubular element and grips into a helical recess of the enclosure part. Also here preferably a rotation of the at least two enclosure parts against one another leads to a rotation of the tubular element relatively to one of the at least two enclosure parts, which comprises the helical recess respectively the helical recesses. Thereby, the pins respectively the one pin of the cage is moved upwards and downwards along the helical recess respectively the helical recesses of the enclosure part.

Alternatively, the transport mechanism can also comprise a sleeve, whereby the sleeve comprises either the one helical recess or the helical recesses or the one vertical recess or respectively the vertical recesses and the sleeve encloses the tubular element or the tubular element encloses the sleeve. In this embodiment the enclosure part does not have to comprise a recess respectively recesses, since a movement of the lipstick is realized by the interaction of the sleeve with the tubular element. Thereby, for example, the pin respectively the pins of the cage extend through the either vertical or helical recess respectively through the vertical or helical recesses of the tubular element and grip into the helical or vertical recess respectively into the helical or vertical recesses of the sleeve. Or the pin respectively the pins of the cage extend through either the vertical or helical recess respectively through the vertical or helical recesses of the sleeve and grip into the helical or vertical recess respectively into the helical or vertical recesses of the tubular element. In this embodiment, for example, the sleeve can be operatively connected with one of the at least two enclosure parts and the tubular element can be operatively connected with the other of the at least two enclosure parts. If the sleeve is rotated against the tubular element, then the cage is moved upwards respectively downwards. Such an embodiment has the advantage that the both enclosure parts can be realized in nearly every size proportion to each other without the restriction that one of the at least two enclosure parts has to enclose the lipstick. In such an embodiment, the sleeve and the tubular element can be operatively connected with different of the at least two enclosure part, wherein the operative connection, preferably is realized in such a way that the tubular element and the sleeve rotate relatively to a rotation of the at least two enclosure parts against one another. A person skilled in the will however also notice that further transport mechanisms are possible to move the lipstick upwards and downwards.

In a further preferred embodiment of the enclosure, the tubular element can also be operatively connected with at least one of the at least two enclosure parts and a motion relatively to the rotation of the at least two enclosure parts can be performed. Thereby, the tubular element can, for example, be directly connected with at least one of the at least two enclosure parts, such that the tubular element is directly rotated, when the at least one of the at least two enclosure parts is rotated. Also an operative connection can for example be performed by a transmission, such that the enclosure part is not directly, however, operatively connected with the tubular element. Thereby, the transmission can for example serve the purpose that the rotation of the at least two enclosure parts against one another can be transferred to the tubular element. This transmission can for example also be used for the purpose that the enclosure parts have to be rotated several times in order to achieve a full rotation of the tubular element, which again leads to the advantage that the upwards and downwards movement of the lipstick, for example, with one of the above described transport mechanisms can be sensitively designed.

In a further preferred embodiment of the enclosure, the tubular element can also be one piece with the at least one of the at least two enclosure parts.

By the above described enclosure for the first time an enclosure, in particular an enclosure for lipsticks is provided, which can be operated with one hand without the disadvantage that a second enclosure part, which serves as cap can be lost and which at the same time exhibits the advantage that the cosmetic product can be sensitively moved out and into the enclosure by means of a rotation.

BRIEF DESCRIPTION OF THE FIGURES

In the following the invention is further described by reference to the schematic illustrations shown in the figures, wherein.

DETAILED DESCRIPTION OF THE INVENTION

Figure 1A:
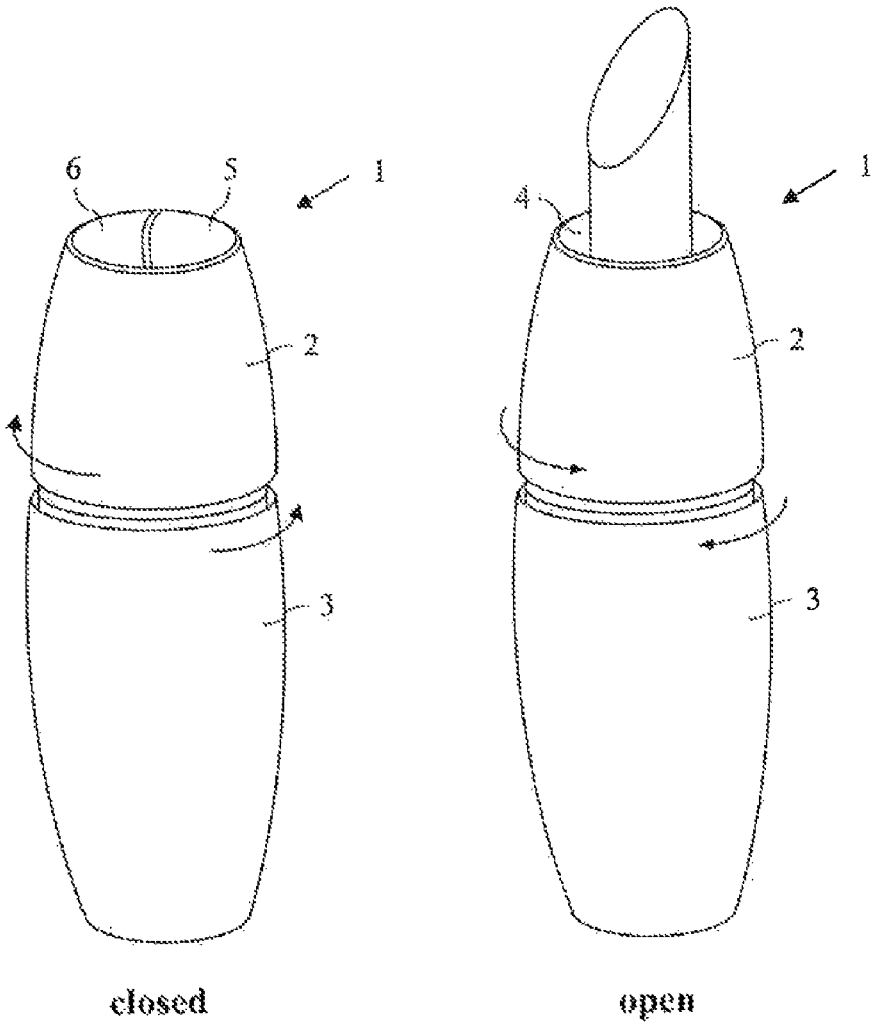
FIG. 1*a* shows a perspective view of an embodiment of an enclosure for a lipstick according to the invention.

FIG. 1*a* shows a perspective view of an embodiment of an enclosure 1 for a lipstick according to the invention, however, this example shall not be limiting and it is evident for a person skilled in the art that the enclosure according to the invention is also suitable to be used with other cosmetic products. In the here shown embodiment, enclosure 1, for example, comprises two enclosure parts 2, 3, wherein the two enclosure parts 2, 3 can be rotated against one another and one of the two enclosure parts 2, in this example the upper one of the two enclosure parts 2, 3 comprises an opening 4. In the embodiment, which is shown here, the opening 4 for example is closed by means of two lids 5, 6. The rotation of the two enclosure parts 2, 3 against one another is indicated by two arrows in opposing directions.

Figure 1B:
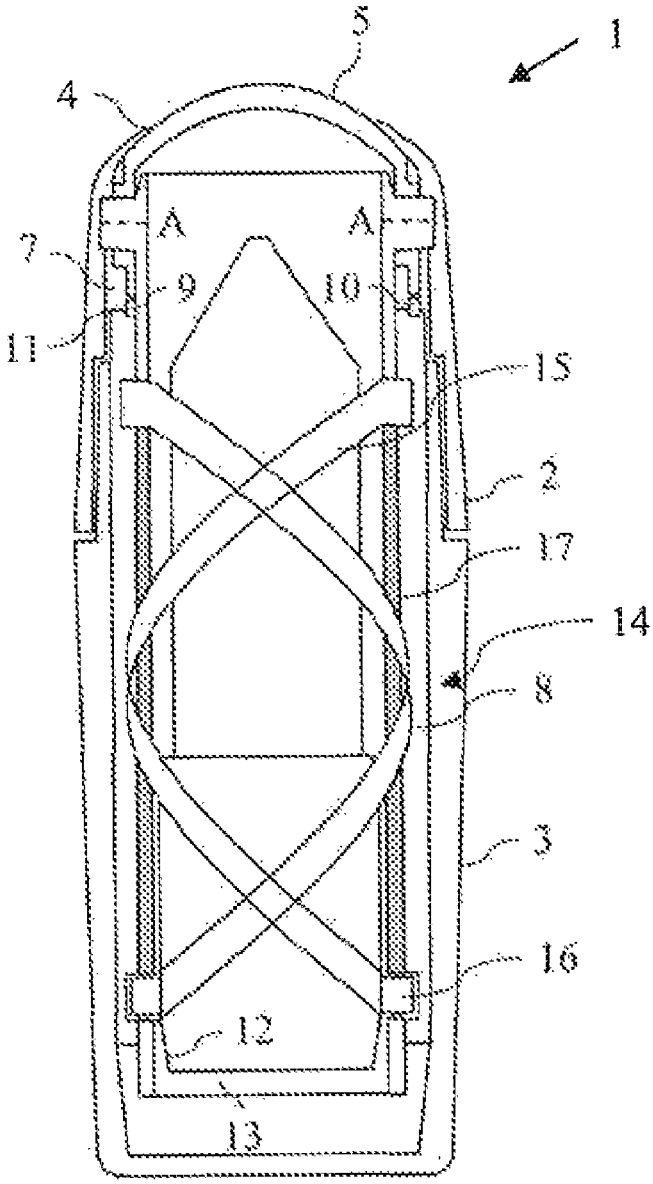
FIG. 1*b* shows a cross section of the embodiment of the enclosure according to the invention, as shown in FIG. 1*a;*

FIG. 1*b* shows a cross section view of the embodiment of enclosure 1 according to the invention, as shown in FIG. 1*a*. In the here shown embodiment, in the inside of the upper enclosure part 2, a closeable opening 4 is arranged. The opening 4 is closed by ease of a closing mechanism, wherein the closing mechanism comprises two lids 5, 6 and a tubular element 8, which in the here shown embodiment extends, for example, between enclosure parts 2, 3. The tubular element 8 and the lids 5, 6 comprise means, in order to transfer the rotation of the enclosure parts 2, 3 in relation to one another into an opening and closing movement of the lids 5, 6. Therefore, the tubular element 8, for example, comprises teeth-segments 9, 10, which can interact with teeth at the lids 5, 6, in such a way that when the tubular element 8 is rotated, the lids 5, 6 are moved. By the movement of the lids 5, 6 away from one another, the opening 4 in enclosure part 2 is opened, if the lids 5, 6 are moved towards one another, then the opening 4 is closed. In the open position, the lids 5, 6 are for example in the here shown embodiment stored in cavity 7, in order to be protected from eventually contamination.

In the here shown embodiment, the teeth of the lids 5, 6 can interact with the teeth-segments 9, 10 on the edge 11 of the tubular element 8. Thereby, the lids 5, 6 are for example pivotable arranged at a rotation axis A in the upper enclosure part 2. In the here shown embodiment, the tubular element 8 is operatively connected with the lower enclosure part 3, so that when enclosure parts 2, 3 are rotated against one another, the tubular element 8 is moved relatively to enclosure part 3. Thereby, the teeth of the lids 5, 6 can interact in such a way with the teeth of the teeth-segments 9, 10 that the lids 5, 6 are opened respectively closed, when the teeth at the lids 5, 6 overlap with the teeth of the teeth-segments 9, 10. The interaction of the teeth of the lids 5, 6 and the teeth-segments 9, 10 is further depicted in FIG. 2.

Further, enclosure 1, as shown in FIG. 1*b*, comprises a transport mechanism for moving the lipstick. This transport mechanism is realized by the tubular element 8, a cage 12 and a sleeve 13. In the here shown embodiment, for example, the tubular element 8 comprises helical recesses 15 into which pins 16 of the cage 12 can grip into. The cage 12, for example, carries the lipstick and can be moved along the helical recesses 15 of the tubular element 8 by rotating the tubular element 8. Thereby, for example the sleeve 13 is arranged inside the tubular element 8 and encloses the lipstick. Thereby, the sleeve 13 for example can comprise vertical recesses 17 through which the pins of the cage 12 can extend and grip into the helical recesses 15 of the tubular element 8. When the sleeve 13 and the tubular element 8 are rotated against one another, then the cage 12 is moved upwards respectively downwards. In the embodiment, which is shown here, the sleeve 13 is operatively connected with the upper enclosure part 2 and the tubular element 8 is operatively connected with the lower enclosure part 3. If the both enclosure parts 2, 3 are rotated against one another, then also the sleeve 13 and the tubular element 8 are rotated against one another, such that the cage 12 is moved along the helical recesses and along the vertical recesses 17. The here shown transport mechanism for moving the lipstick only represents one type of a transport mechanism, however, a person skilled in the art will also notice that this example is not limiting and also other types of transport mechanisms are possible.

Figure 2:
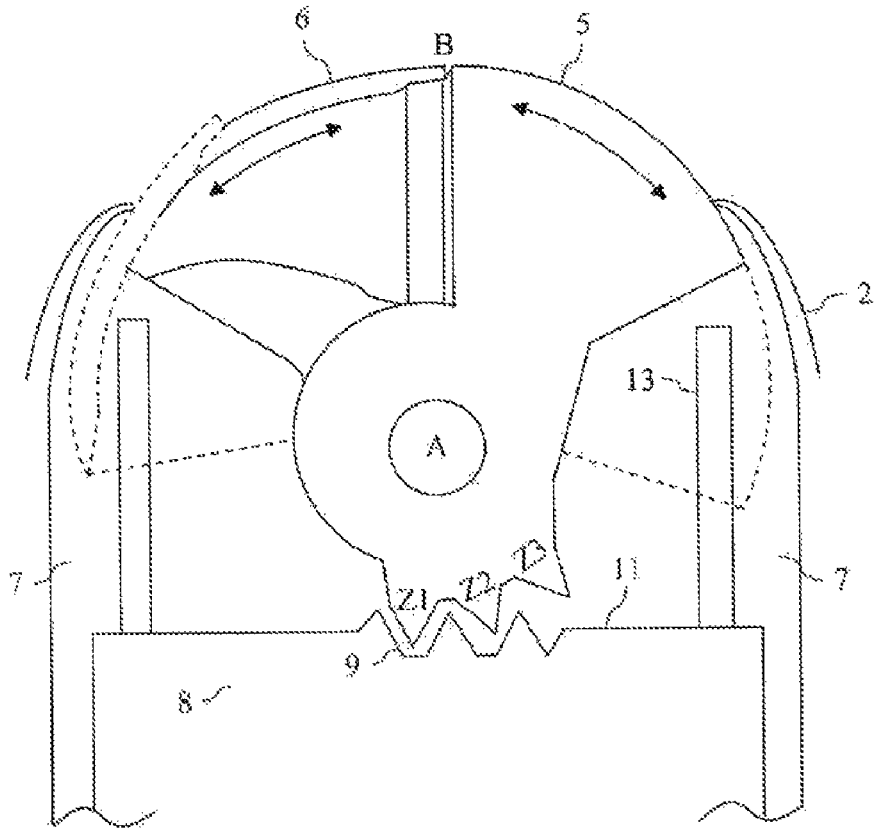
FIG. 2 shows a cross section of a closing mechanism for the embodiment of the enclosure according to the invention, as shown in FIGS. 1*a*, 1*b*.

FIG. 2 shows a cross section of a closing mechanism of the embodiment of enclosure 1 according to the invention, as shown in FIGS. 1*a*, 1*b*. In detail, FIG. 2 shows a cross section of the upper enclosure part 2 of enclosure 1 as shown in FIGS. 1*a*, 1*b*. Inside the upper enclosure part 2 there is a rotation axis A at which the two lids 5, 6 are pivotable arranged. Thereby, the solid lines indicate the lids 5, 6 in the closed position and the dashed lines indicate the lids 5, 6 in the open position. The here shown lids 5, 6 have a circular type cross section and overlap each other at an overlapping line B. In the open position the lids 5, 6 are stored in the cavity 7, such that the lids 5, 6 can not be contaminated, when the lipstick is moved out of the opening 4. Further, the cavity 7 can also represent a limiting of the motion of the lids 5, 6.

As means for transferring the rotation of the tubular element 8 onto the lids 5, 6, the here shown lids 5, 6 comprise teeth Z1, Z2, Z3, these teeth Z1, Z2, Z3 can interact with the teeth of teeth-segments 9, 10 of the tubular element 8. If the tubular element 8 is rotated, for example, by rotating the enclosure parts 2, 3 against one another, then for example the teeth-segment 9 is moved to the left, whereby tooth Z1 of lid 5 is freed and tooth Z2 of lid 5 is moved further to the middle. By ease of this motion lid 5 is opened. By means of a second teeth-segment 10, which is arranged on the opposing edge 11 of the tubular element 8 also lid 6 is opened. Opposing in this context means that the two segments have an offset of approximately 180° on the edge 11 of the tubular element. When all three teeth Z1, Z2, Z3 of lids 5, 6 have interacted with the teeth of teeth-segments 9, 10 of the tubular element 8, then the lids 5, 6 are completely opened and stored in cavity 7. Since no further teeth-segments are arranged on the edge 11 of the tubular element 8, the tubular element 8 can be further rotated without that a further motion of the lids 5, 6 is performed. Caused by the arrangement of the teeth-segments on two different circular paths with different radii, as further shown in FIG. 3, a nearly full rotation is available until the teeth Z1, Z2, Z3 of lids 5, 6 can again overlap with the corresponding teeth of teeth-segments 9, 10. This has the advantage that nearly a full rotation of the tubular element 8 is available in order to sensitively move the lipstick. Further, the sensitive motion can also be supported by the fact that between the enclosure part 3 and the tubular element 8 a transmission is arranged, such that several rotations of the lower enclosure part 3 are necessary to achieve a full rotation of the tubular element 8. The nearly full rotation of the tubular element 8 is achieved as described above by a particular arrangement of the teeth-segments 9, 10 on the edge 11 of the tubular element 8. This arrangement is shown in detail in FIG. 3.

Figure 3:
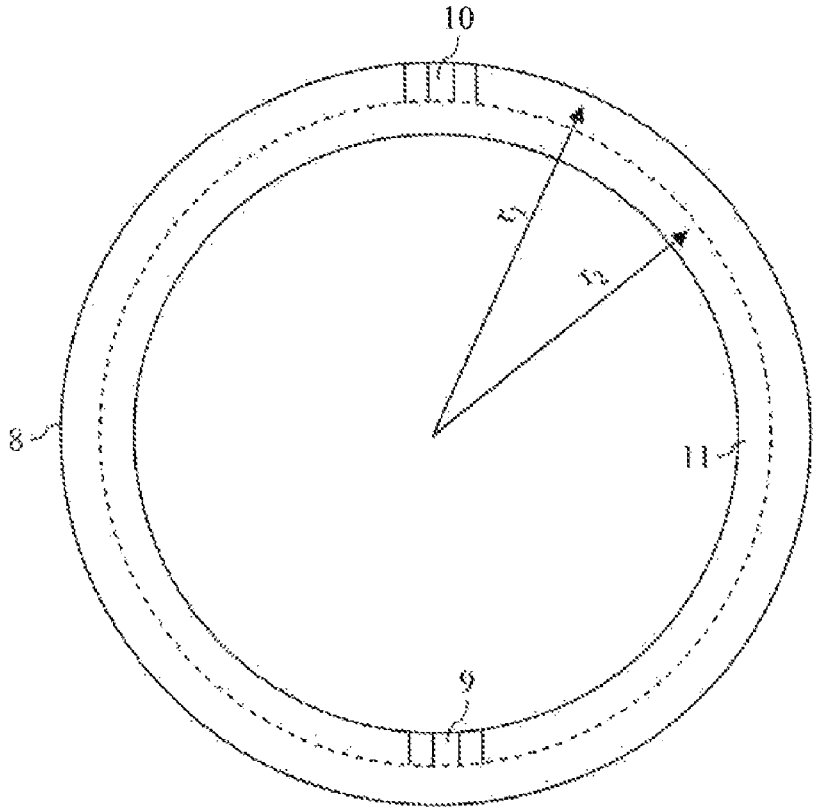
FIG. 3 shows a top view of a tubular element of a closing mechanism for the embodiment of the enclosure according to the invention, as shown in FIGS. 1*a*, 1*b*.

FIG. 3 shows a top view of the tubular element 8 of the closing mechanism of the enclosure 1, as shown in FIGS. 1*a*, 1*b*. On the edge 11 of the tubular element 8, two teeth-segments 9, 10 are arranged on two circular paths with different radii r1, r2 with an offset of approximately 180°. If the tubular element 8 is rotated, then the teeth of the teeth-segments 9, 10 can only interact with the teeth Z1, Z2, Z3 of the lids 5, 6 as long as they overlap. When the teeth Z1, Z2, Z3 of the lids 5, 6 do not overlap with the teeth of the teeth-segments 9, 10 anymore, then no motion transfer is performed. Since the teeth-segments 9, 10 are arranged on two circular paths with two different radii r1, r2 an overlap of the teeth Z1, Z2, Z3 of the lids 5, 6 with the teeth of the teeth-segments 9, 10 occurs only once per rotation, since per radii only one teeth-segment 9, 10 is arranged. By this differentiating arrangement of the teeth-segments 9, 10 a merely full rotation of the tubular element 8 is possible before the teeth Z1, Z2, Z3 of the lids 5, 6 again can interact with the teeth of the teeth-segments 9, 10. A full rotation of the tubular element 8 is however in the here shown embodiment limited by the design of the helical recesses of the tubular element 8. If the tubular element 8 is rotated the other way around, then again after a merely full rotation, the teeth of the teeth-segments 9, 10 can again interact with the corresponding teeth Z1, Z2, Z3 of lids 5, 6, such that the lids 5, 6 can be closed. Also here a limiting is possible by the design of the helical recesses in the tubular element 8. However, also a limiting can be arranged inside the connection of enclosure parts 2, 3 or can be provided by other means, which seem to be suitable for a person skilled in the art for limiting the movement.

The invention claimed is:

1. Enclosure (1), in particular for a lipstick comprising:

at least two enclosure parts (2, 3), wherein the at least two enclosure parts (2, 3) can be rotated relatively to one another and at least one of the at least two enclosure parts (2, 3) comprises an opening (4); and a closing mechanism, wherein the closing mechanism comprises:

two lids (5, 6) by which the said one opening (4) in one of the at least two enclosure parts (2, 3) can be closed; and a tubular element (8), which rotates relatively to one of the at least two enclosure parts (2, 3), when the at least two enclosure parts (2, 3) are rotated in relation to one another, wherein each of the two lids (5, 6) comprises teeth (Z1, Z2, Z3) and the tubular element (8) comprises two teeth-segments (9, 10), wherein the teeth (Z1, Z2, Z3) of one of the two lids (5, 6) grip into the teeth of one of the two teeth-segments (9, 10) of the tubular element (8) and the teeth (Z1, Z2, Z3) of the other of the two lids (5, 6) grip into the teeth of the other of the two teeth-segments (9, 10) of the tubular element (8) for moving the two lids (5, 6) when the tubular element (8) is rotated, in such a way that the lids (5, 6) close or open the opening (4), and wherein the tubular element (8) defines a first path (r1) and a second path (r2) positioned radially outwardly from the first path (r1), the first of the two teeth-segments (9)

being located in the first path (r1) and the second of the two teeth-segments (10) being located in the second path (r2) thereby positioning the teeth-segments (9, 10) in radially different paths.

2. Enclosure (1) of claim 1, wherein the teeth-segments (9, 10) of the tubular element (8) are arranged at the edge (11) of the tubular element (8).

3. Enclosure (1) of claim 1, wherein the teeth-segments (9, 10) are opposed on the tubular element (8).

4. Enclosure (1) of claim 1, wherein at least one enclosure part (2, 3) comprises a cavity (7) for the two lids (5, 6) of the closing mechanism.

5. Enclosure (1) of claim 1, wherein the closing mechanism comprises a means for holding the lids (5, 6) in a particular position.

6. Enclosure (1) of claim 1, wherein the closing mechanism further comprises a limiter for limiting the rotation of the at least two enclosure parts (2, 3) against one another.

7. Enclosure (1) of claim 1, further comprising a transport mechanism for transporting the lipstick out of one of the at least two enclosure parts (2, 3) through the opening (4) or into the one of the at least two enclosure parts (2, 3) through the opening (4), wherein the transport mechanism comprises a cage (12), which at least partially holds the lipstick and wherein the cage (12) is moved by the rotation of the at least two enclosure part (2, 3) against one another.

8. Enclosure (1) of claim 7, wherein the transport mechanism is represented by an interaction of the cage (12) and the tubular element (8).

9. Enclosure (1) of claim 8, wherein the cage (12) at least comprises one pin and the tubular element (8) comprises at least one helical shaped recess (15) for accommodating the pin (16) of the cage (12), wherein by rotating the tubular element (8) the cage (12) is moved along the helical shaped recess (15).

10. Enclosure (1) of claim 1, wherein the tubular element (8) is operatively connectable with at least one of the at least two enclosure parts (2, 3) and the tubular element (8) performs a motion relatively to the rotation of the at least two enclosure parts (2, 3) against one another.

11. Enclosure (1) of claim 10, further comprising a transmission (14) for operatively connecting the tubular element (8) with at least one of the at least two enclosure parts (2, 3) for transferring the rotation of the at least two enclosure parts (2, 3) against one another onto the tubular element (8).

12. Enclosure (1) of claim 1, wherein the tubular element (8) is designed as one piece with the at least one of the at least two enclosure parts (2, 3).

* * * * *